United States Patent [19]

Zingg et al.

[11] Patent Number: 4,662,401

[45] Date of Patent: May 5, 1987

[54] HIGH PRESSURE CHOKE ASSEMBLY

[75] Inventors: Warren M. Zingg; Larry D. Welch, both of Tulsa County, Okla.

[73] Assignee: Dowell Schlumberger Incorporated, Tulsa, Okla.

[21] Appl. No.: 185,087

[22] Filed: Sep. 8, 1980

[51] Int. Cl.[4] ..... F15C 1/20

[52] U.S. Cl. ..... 137/824; 137/599; 138/44; 166/91

[58] Field of Search ..... 137/822, 823, 824, 835, 137/599; 138/44, 45, 46; 166/91, 75 R

[56] References Cited

U.S. PATENT DOCUMENTS

| | | | |
|---|---|---|---|
| 2,173,022 | 9/1939 | Mitchell | 138/46 |
| 2,316,383 | 4/1943 | Abercrombie | 166/91 |
| 2,672,159 | 3/1954 | Walton | 138/44 |
| 2,815,923 | 12/1957 | Clark | 138/46 |
| 3,018,799 | 1/1962 | Volkmonn et al. | 138/44 |
| 3,145,529 | 8/1964 | Maloof | 138/44 |
| 3,477,467 | 11/1969 | Sewell et al. | 137/599 |
| 3,486,521 | 12/1969 | Mayer | 137/824 |
| 3,608,631 | 9/1971 | Sizer et al. | 166/91 |
| 3,712,324 | 1/1973 | Munch | 137/824 |
| 3,921,672 | 11/1975 | Arnold | 138/44 |
| 4,126,181 | 11/1978 | Black | 166/75 R |

FOREIGN PATENT DOCUMENTS

| | | | |
|---|---|---|---|
| 394590 | 1/1974 | U.S.S.R. | 138/44 |

*Primary Examiner*—A. Michael Chambers
*Attorney, Agent, or Firm*—L. Wayne White

[57] ABSTRACT

A pressurized fluid is "let-down" to atmospheric pressure as it passes through a choke assembly having two pressure orifices (choke flow beans) which are in-line and directly opposite and which are designed to deliver jet streams of generally equal force to a common in-line focal point. The choke assembly is a fixed-rate system where the volume throughput is regulated primarily by the pressure on the fluid.

7 Claims, 3 Drawing Figures

HIGH PRESSURE CHOKE ASSEMBLY

BACKGROUND OF THE INVENTION

1. Field of the Invention

This invention pertains to a novel choke assembly which is particularly useful in reducing pressurized fluids from a high pressure to atmospheric pressure. One embodiment of the invention is particularly useful in combination with a slurry concentrator in which it is necessary to reduce the pressure of the return fluids to atmospheric pressure before the fluids can be recycled.

2. Description of the Prior Art

A wide variety of mechanical devices have been developed for depressurizing fluids (liquids and/or gases). Such fluids have normally been pressurized initially to accomplish a particular chemical or physical feat (e.g. a high pressure chemical reaction, a hydraulic fracturing of a subterranean formation, etc.) or they have been incidentially pressurized. In any event, the pressure generally has to be relieved to make the operation useful. A variety of mechanical devices have been developed to relieve or depressurize fluids. Some of these mechanical devices and theoretical discussions on how they work are described, for example, in handbooks by W. L. McCabe et al., *Unit Operations of Chemical Engineering,* 3rd Edition, McGraw-Hill, Inc. (1976) and by R. H. Perry et al., *Chemical Engineers Handbook,* 5th Edition, McGraw-Hill Book Company (1973) and in the technical/patent literature. The prior art devices have included orifices, nozzles, short tubes, etc. These devices, of course, have been designed to regulate or measure the pressures or volumes of the constantly flowing fluids where the volume throughput is regulated primarily by the pressure; such devices are designated herein as "fixed rate" choke devices (as opposed to valve systems which are variable rate in the sense that the volume throughput is determined by opening or closing a valve at substantially constant pressure).

Chokes have been widely used in the oilfield to control the flow rate of high pressure fluids (liquids and/or gases) issuing from the wells. These chokes are usually centered in the flow line so that the velocity decays to a point where the fluid emitted no longer erodes the wall of the piping. Several feet of pipe may be required before the velocity of the fluid is reduced to a point where it is no longer destructive. The configuration of the choke and the minimum length of pipe depends, of course, on the pipe diameter, pressures incurred, the presence or absence of abrasive particles (e.g. sand or bauxite), etc. Another method used in the oilfield has been to direct the pressurized stream of fluid against a sacrificial plug or target (usually made of steel) that is placed in the flow line. This is a moderately effective system, but it represents a brute force type of approach that can result in destruction of the system because of vibration, etc.

Similar problems have been encountered with attempts to control the volume of fluid where there is a pressure differential. Valve Concepts International advertised a valve that is said to be useful at high pressures. This valve appears to consist of a sliding gate circumscribing a cylindrical surface having concentric holes (ports) positioned directly opposite one another in the seat nozzle. The position of the ports directs the flow upon itself and contains the energy, according to the advertisement, and thereby protects the valve body. The volume of fluid flowing through the valve is variable and is governed by the positioning of the gate relative to the series of ports. This valve differs from the present choke system in that it contains a multiplicity of ports rather than two and has a variable volume rather than a fixed or steady state of flow.

SUMMARY OF THE INVENTION

A choke assembly has now been discovered which comprises:

(a) a source of high pressure fluid which is in fluid communication with (b) two pressure control devices having orifices which are coaxial and diametrically opposed and designed to deliver jet streams of generally equal force to a common coaxial focal point.

The novel choke assembly is exceedingly efficient in "letting down" or depressurizing a high pressure fluid to atmospheric pressure.

DETAILED DESCRIPTION OF THE INVENTION

Figure 1:
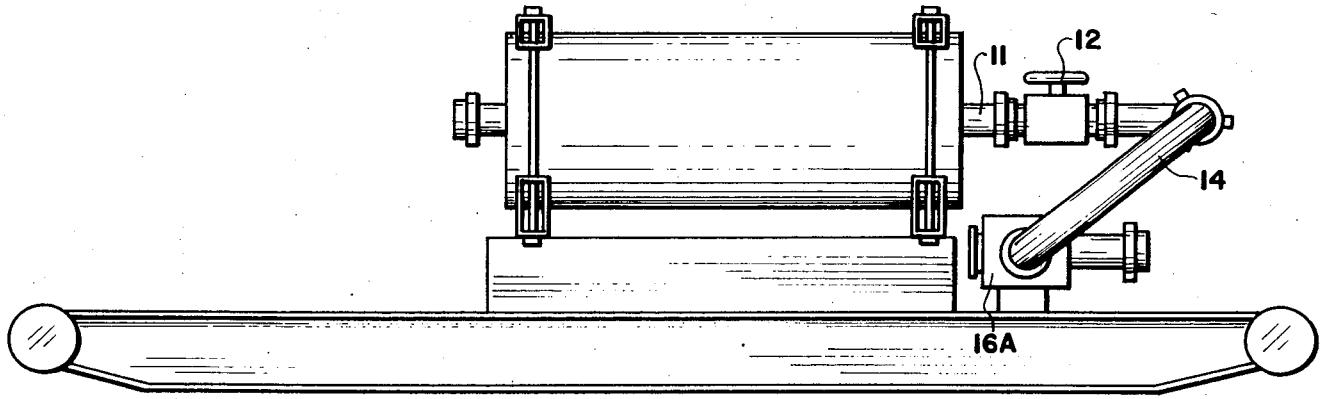
FIG. 1 shows a schematic of the novel fixed rate choke assembly as connected to the slurry concentrator described by Zingg, supra. This is the preferred embodiment of the invention.
Figure 2:
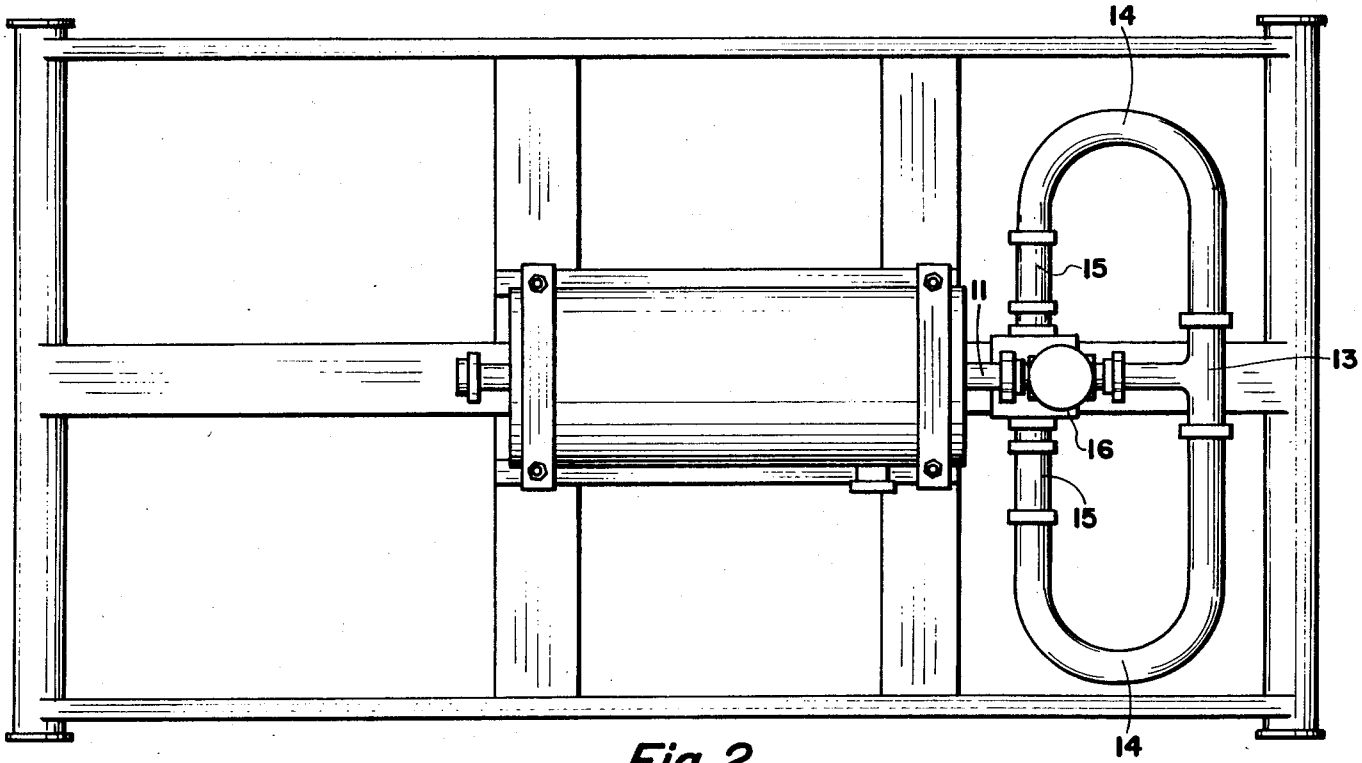
FIG. 2 is a top schematic view.
Figure 3:
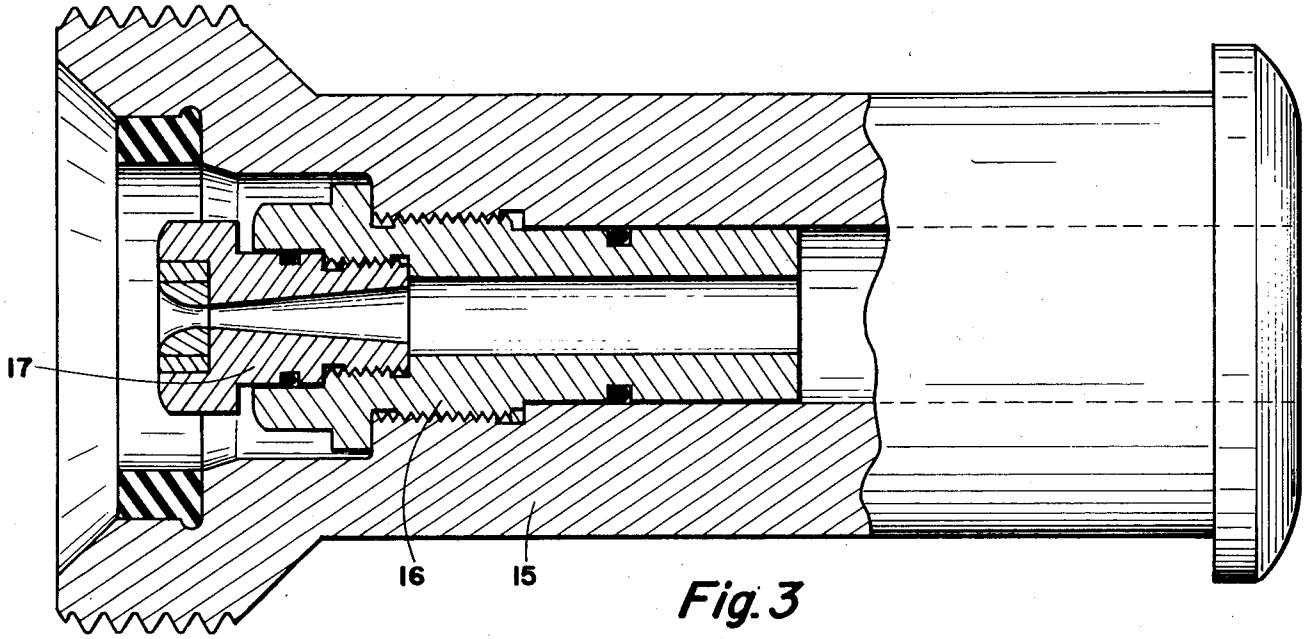
FIG. 3 is a side schematic view of a choke nipple containing a choke adaptor and a choke flow bean.

Note that in FIGS. 1, 2 and 3 that the choke assembly is shown as a loop-shaped device comprising (a) a source of high pressure fluid (11) which is in fluid communication with a conduit containing a valve (12) which is preferably a remotely controlled hydraulically actuated valve (e.g., a gate valve), which regulates the flow of fluids through said conduit) and which discharges into (c) a diverting means (13) for dividing the high pressure fluid into two generally equal streams which flow into (d) separate conduit means (14) directing each of the equal streams into (e) one of two pressure control devices having orifices which are positioned in-line (i.e., coaxially) and directly opposite each other (i.e., diametrically opposed) and which are designed to deliver jet streams of fluid of substantial equal force to a common in-line focal point which is (f) enclosed in a container (16A) from which the fluid is collected and withdrawn at about atmospheric pressure. The pressure control devices (17) are normally contained within a choke nipple (15) by use of a choke adaptor (16). These pressure control devices are alternatively referred to in the industry as "choke flow beans".

There are many such pressure control devices containing orifices which are known and which can be adapted for use herein by the skilled artisan. However, the choke flow bean described by Warren M. Zingg in a commonly owned, copending patent application sumitted even date herewith entitled "Choke Flow-Bean", Ser. No. 185,061 filed 09/08/80, now abandoned, is preferred; the disclosure of which is incorporated herein by reference.

The choke assembly can be varied in size to convenience and it has been readily adapted as an integral part of a mobile slurry concentrator. This embodiment is shown in a commonly owned copending application filed even date herewith by Warren M. Zingg, entitled "Slurry Concentrator and Methods of Use", Ser. No. 185,065 filed 09/08/80 now U.S. Pat. No. 4,354,422 issued 10/09/82 the disclosure of which is incorporated herein by reference.

Likewise, the materials of construction can be varied to convenience so long as due regard is given to the pressure limitations to which the particular apparatus will be exposed. Steel is the most conventional material of construction and is, therefore, normally used.

While FIGS. 1–3 show the choke assembly as a loop-shaped device having a common source of high energy fluid. It will be readily apparent to the skilled artisan, however, that more than one source of high energy fluid could be fed into the "loop" or, the loop could be severed such that each of the pressure control orifices would be emitting high pressure jet streams of fluid derived from separate sources.

EXPERIMENTAL

The following example will further illustrate the invention.

EXAMPLE 1

A choke assembly as described herein and illustrated by FIGS. 1–3 was combined with the slurry concentrator described by Zingg, supra. The lighter clarified fluid withdrawn from the slurry concentrator via the first discharge conduit entered the choke assembly through conduit containing a remotely controlled hydraulically actuated gate valve and discharged into a diverting means (tee-joint or y-bend piping) where the high pressure fluid was divided into two generally equal streams. Each of these streams flowed through separate conduits to one of two pressure control devices having orifices which were positioned in-line and directly opposite each other. These pressure control devices were those described by Zingg, supra Ser. No. 185,061, filed 09/08/80, now abandoned, and they delivered jet streams of fluid to a common in-line focal point where the counter-current flow of liquids gave a fluid discharge at essentially atmospheric pressure. This was an outstanding performance in light of the fact that the initial fluid entering the choke assembly was at pressure exceeding 10,000 psi.

A choke assembly as described herein and illustrated by FIGS. 1–3 can also be adapted to depressurize or "let-down" a well after fracturing. The wellhead pressure in such instance would be the source of high pressure fluid.

What is claimed is:

1. A choke assembly for reducing the pressure of high pressure fluids to essentially atmospheric pressure consisting essentially of:

(a) a source of high pressure fluid which is in fluid communication with (b) a conduit containing a remotely controlled hydraulically actuated valve which regulates the flow of fluids through said conduit and which discharges into (c) a means for dividing the high pressure fluid into two generally equal streams which flow into (d) separate conduits directing each of said equal streams to (e) one of two choke flow beans which are positioned in-line and directly opposite each other and which are designed to deliver jet streams of fluid of generally equal force to a common in-line focal point which is (f) enclosed in a container from which the fluid is collected and withdrawn at generally atmospheric pressure.

2. The choke assembly defined by claim 1 wherein said valve is a high pressure gate valve.

3. The choke assembly defined by claim 1 wherein said assembly is adapted for use in combination with a mobile slurry concentrator by fluid communication means capable of delivering a high pressure fluid from said slurry concentrator to said choke assembly.

4. In the method of depressurizing a stream of high pressure fluid by passing said fluid through a choke flow apparatus, the improvement comprising using the choke flow assembly defined by claim 1 as said choke flow apparatus.

5. The choke assembly defined by claim 1 wherein said choke flow beans comprise:

a housing have a first end and second end defining a bore of generally circular cross section which extends, along with its axis of generation, from the first end to a second end, the bore being of varying diameter along its axis of generation with regions of large diameter adjacent the first and second ends of the housing, a region of minimum diameter, d, intermediate the first and second ends, the bore having a general configuration approximating that of a trumpet bell between the first end and the region of minimum diameter, the bore having a frustoconical configuration between the first end and the region of minimum diameter with a total included angle of from about 4° to about 8° and having a length along the axis of generation of up to about $9d$ between the region of minimum diameter and the second end.

6. The choke assembly defined by claim 5 in which the total included angle of said choke flow bean is from about 5° to about 7°.

7. The choke assembly defined by claim 6 in which the total included angle of said choke flow bean is about 5°.

* * * * *